US008398785B2

(12) United States Patent
Marschall

(10) Patent No.: US 8,398,785 B2
(45) Date of Patent: Mar. 19, 2013

(54) RIGID LANCE CLEANING SYSTEM AND METHOD THEREFOR

(75) Inventor: Matthew S. Marschall, Fowlerville, MI (US)

(73) Assignee: NLB Corp., Wixom, MI (US)

( * ) Notice: Subject to any disclaimer, the term of this patent is extended or adjusted under 35 U.S.C. 154(b) by 613 days.

(21) Appl. No.: 12/538,192

(22) Filed: Aug. 10, 2009

(65) Prior Publication Data

US 2011/0030734 A1 Feb. 10, 2011

(51) Int. Cl.
*B08B 9/00* (2006.01)
*B08B 9/04* (2006.01)
*B08B 9/043* (2006.01)

(52) U.S. Cl. ..... 134/168 C; 134/166 C; 134/167 C; 165/95

(58) Field of Classification Search ..... 134/166 C, 134/172, 166 R, 167 R, 168 R, 168 C, 167 C, 134/169 R; 165/95
See application file for complete search history.

(56) References Cited

U.S. PATENT DOCUMENTS 4,095,305 A * 6/1978 Goodwin ..... 15/104.095
4,856,545 A * 8/1989 Krajicek et al. ..... 134/166 C
5,002,120 A * 3/1991 Boisture et al. ..... 165/95
5,022,463 A * 6/1991 Boisture ..... 165/95
5,067,558 A * 11/1991 Boisture ..... 165/95
5,129,455 A * 7/1992 Boisture ..... 165/95
5,160,548 A * 11/1992 Boisture ..... 134/7
5,184,636 A * 2/1993 van der Woude ..... 134/167 C
5,348,234 A * 9/1994 v.d. Woude ..... 239/753
5,397,057 A * 3/1995 Verstraeten ..... 239/198
6,681,839 B1 * 1/2004 Balzer ..... 165/11.2
6,757,932 B1 * 7/2004 Verstraeten ..... 15/315
2005/0109377 A1 * 5/2005 Schliephake et al. ..... 134/22.11
2006/0185691 A1 * 8/2006 Joseph ..... 134/22.1
2009/0255557 A1 * 10/2009 Gardner et al. ..... 134/18

OTHER PUBLICATIONS

Definition of bushing by the Free Online Dictionary, no date.*

* cited by examiner

*Primary Examiner* — Alexander Markoff
(74) *Attorney, Agent, or Firm* — Carlson, Gaskey & Olds PC

(57) ABSTRACT

A rigid lance cleaning system includes rigid tubular lances that are movable between retracted and extended positions for delivering a cleaning fluid. Flexible hoses are connected to respective rigid tubular lances for delivering the cleaning fluid. A hose reel is configured to dispense the flexible hose when the rigid tubular lances extend and collect the flexible hoses when the rigid tubular lances retract. A frame movably supports the rigid tubular lances and a drive system is configured to selectively extend and retract the rigid tubular lenses.

32 Claims, 6 Drawing Sheets

RIGID LANCE CLEANING SYSTEM AND METHOD THEREFOR

BACKGROUND OF THE INVENTION

This disclosure relates to cleaning systems for heat exchanger tube bundles or the like.

Heat exchangers are known and used for transferring heat from a passing fluid to a working fluid conveyed through tube bundles. During operation, the interior of the tube bundles may collect deposits from elements within the working fluid such as debris, dirt, or other sources. The deposits may inhibit heat transfer. From time to time the tube bundles are cleaned to remove the deposits and restore efficient heat transfer.

One technique for cleaning the tube bundles involves inserting a smaller tube into each tube of the tube bundles and delivering high pressure cleaning fluid through the smaller tube to mechanically remove the deposits. In some cases, the smaller tube, or lance, may be a manually operated device such that is simply inserted into each tube. More recently, however, devices have been developed that include multiple lances for cleaning multiple tubes of the tube bundles at one time.

One challenge associated with multi-lance systems is that the tube bundles are relatively large and, therefore, the cleaning system used is also large and difficult to maneuver. For instance, the lances of the cleaning system must be relatively precisely aligned with the tubes of the heat exchanger in order to avoid damaging the heat exchanger or the cleaning system. Moreover, different tube bundles of different heat exchangers may have different sizes or spacing between the tube centerlines.

SUMMARY OF THE INVENTION

An exemplary rigid lance cleaning system includes rigid tubular lances that are movable between retracted and extended positions for delivering a cleaning fluid. Flexible hoses are connected to respective rigid tubular lances for delivering the cleaning fluid thereto. A hose reel is configured to dispense the flexible hose when the rigid tubular lances extend and collect the flexible hoses when the rigid tubular lances retract. A frame movably supports the rigid tubular lances and a drive system is configured to selectively extend and retract the rigid tubular lances.

An example method of cleaning tube bundles using a rigid lance cleaning system includes moving rigid tubular lances between retracted and extended positions relative to tube bundles and moving flexible hoses in unison with the rigid tubular lances. The flexible hoses are connected to respective ones of the rigid tubular lances. The flexible hose is dispensed from a hose reel when the rigid tubular lances extend and is collected on the hose reel when the rigid tubular lances retract. High pressure cleaning fluid is selectively supplied through the hose reel to the flexible hoses to deliver the cleaning fluid to the rigid tubular lances. The rigid tubular lances are movably supported within a frame. A drive system is selectively actuated to extend and retract the rigid tubular lances relative to the tube bundles.

In embodiments, the rigid lance cleaning system may include a pitch adjuster that is arranged with the rigid tubular lances and configured to change a spacing between centerlines of the rigid tubular lances. A hose connector may also be fluidly connected with each individual flexible hose to a corresponding one of the rigid tubular lances. The frame may also include an operator platform and at least one latch that is configured to selectively secure the operator platform at a desired position. Additionally, the drive system may include first and second hydraulic actuators that are configured to respectively move the rigid tubular lances and the hose reel, with the first and second hydraulic actuators being hydraulically interconnected.

BRIEF DESCRIPTION OF THE DRAWINGS

The various features and advantages of the disclosed examples will become apparent to those skilled in the art from the following detailed description. The drawings that accompany the detailed description can be briefly described as follows.

DETAILED DESCRIPTION OF THE PREFERRED EMBODIMENT

Figure 1:
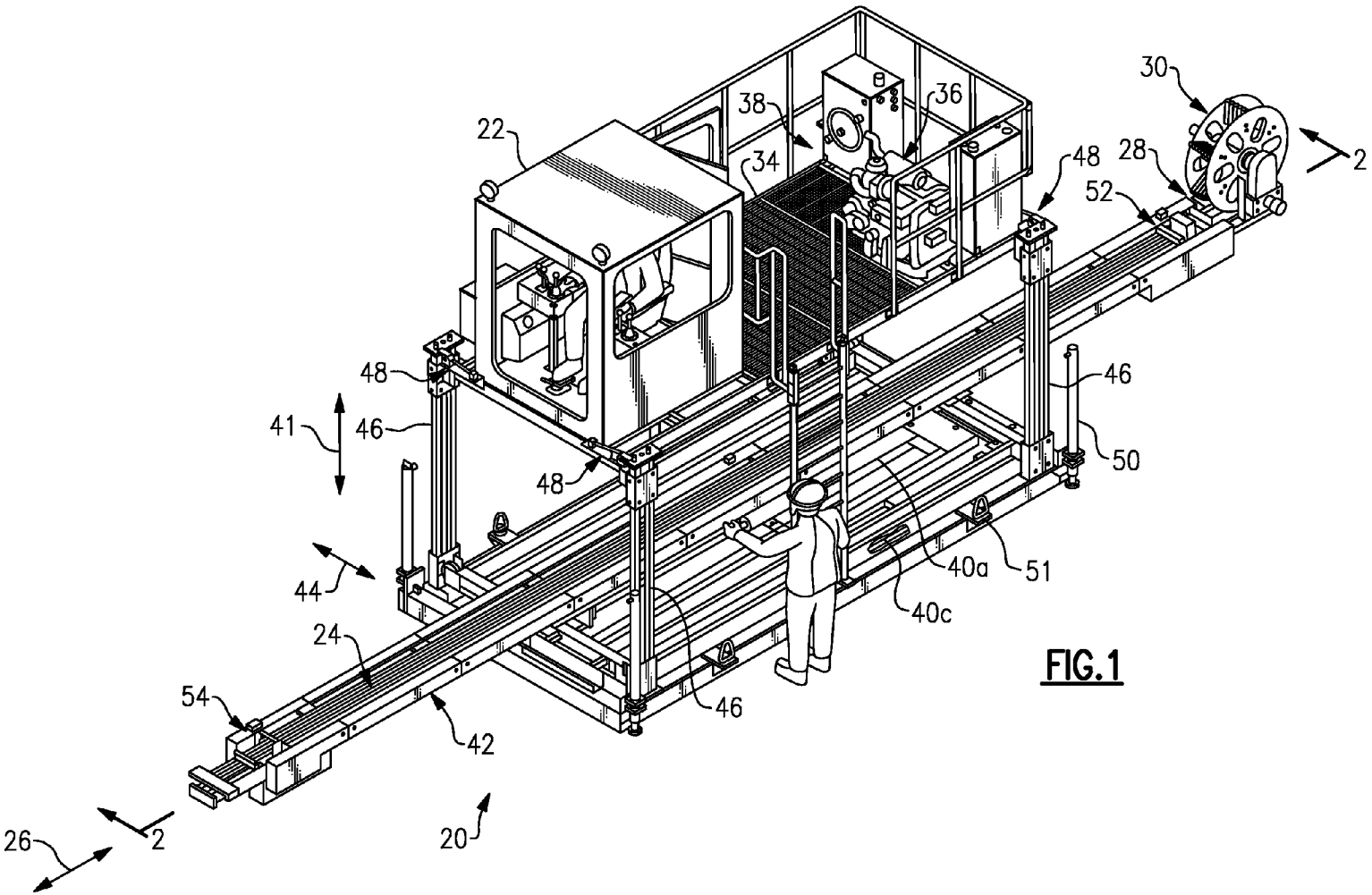
FIG. 1 illustrates an example rigid lance cleaning system.
Figure 2:
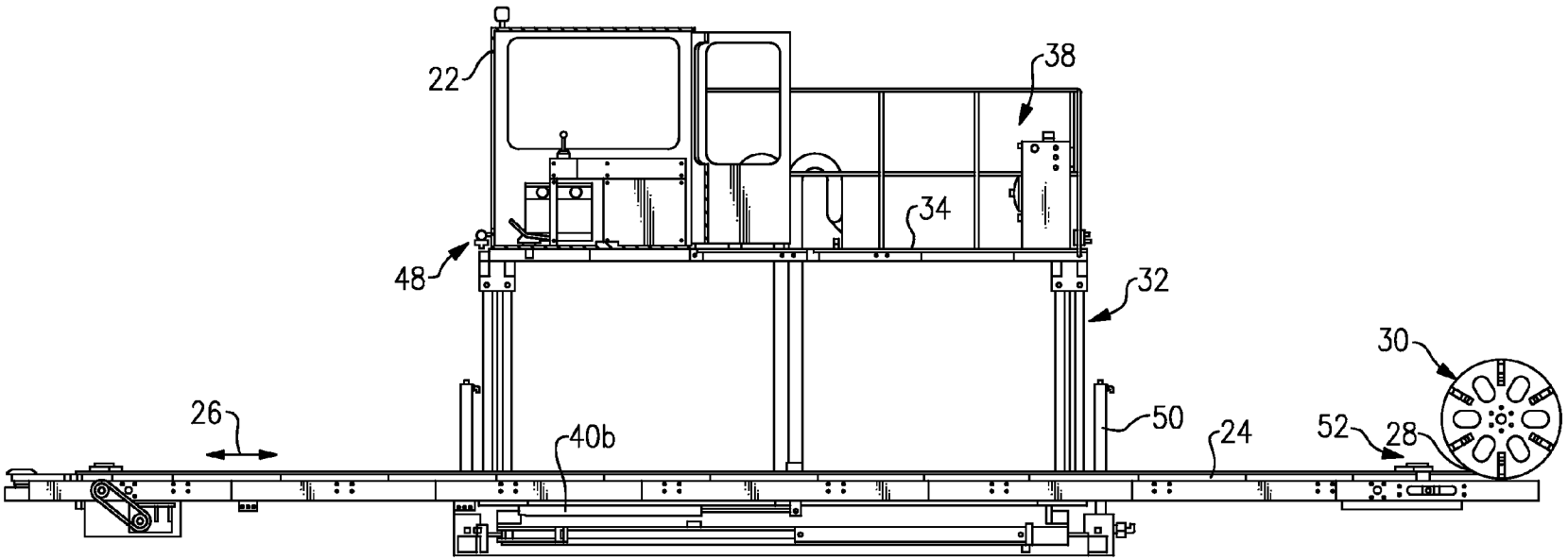
FIG. 2 illustrates a cross-section of the exemplary rigid lance cleaning system illustrated in FIG. 1.

FIGS. 1 and 2 illustrate selected portions of an example rigid lance cleaning system 20 for cleaning interiors of tube bundles of a heat exchanger or other similar components. As may be appreciated from the following description, the exemplary rigid lance cleaning system 20 includes components and features that need not necessarily all be included on a single system. For convenience, however, the components and features are described with reference to the system illustrated in FIGS. 1 and 2.

In general, the exemplary rigid lance cleaning system 20 provides a self-contained unit that may be used to clean heat exchanger tube bundles without the need for outside power. In this example, an operator may control the function of the rigid lance cleaning system 20 from an operator cab 22 such that limited or no help is needed from additional operators.

In the disclosed example, the rigid lance cleaning system 20 includes a plurality of rigid tubular lances 24 that are movable along translation direction 26 between retracted and extended positions for delivering a cleaning fluid to the interior of tube bundles. The rigid tubular lances are shown in a retracted position. For example, the cleaning fluid may be high pressure water that is delivered through the rigid tubular lances 24 to a nozzle or other spray device coupled to the free ends of the rigid tubular lances 24 in a known manner.

Each of the rigid tubular lances 24 is connected to a respective flexible hose 28 that delivers the cleaning fluid to the rigid tubular lances 24. The flexible hoses 28 are held on a hose reel 30 that dispenses the flexible hoses 28 when the rigid tubular lances 24 extend and collects the flexible hoses 28 when the rigid tubular lances 24 retract.

A frame 32 movably supports the rigid tubular lances 24 along with the operator cab 22 and an operator platform 34. In this case, a primary hydraulic pump 36 is also mounted on the operator platform 34 and is generally part of a drive system 38 that is configured to selectively extend and retract the rigid tubular lances 24. The drive system 38 is hydraulically connected with hydraulic cylinders 40*a-c* generally mounted below the rigid tubular lances 24 within the frame 32 for selectively moving a lance bed 42 in which the rigid tubular lances 24 are mounted and the operator platform 34. For instance, the hydraulic cylinders 40*a-c* may be configured with cables such that the cylinder 40*a* is operative to move the operator platform 34 and lance bed 42 up/down in direction 41, cylinder 40*b* is operative to move the lance bed 42 along direction 26, and cylinder 40*c* is operative to move the lance bed 42 along direction 44. Given this description, one of ordinary skill in the art will recognize other arrangements of the frame 32 to suit their particular needs.

The frame 32 may also include platform guide members 46 on which the operator platform 34 is mounted for vertical movement such that the operator within the operator cab 22 is in position to view insertion of the rigid tubular lances 24 into the tube bundles. The frame 32 may include one or more latches 48 for selectively locking the operator platform 34 at an operating position relative to the platform guide members 46. The operator platform 34 is shown in the example operating position, with the platform near the top of the platform guide members 46. As will be described, the latches 48 may be unlocked such that the operator platform 34 can be lowered to a storage position, such as for transporting the rigid lance cleaning system 20.

The rigid lance cleaning system 20 may also include levelers 50 associated with the frame 32 for leveling the frame 32 and to facilitate stabilizing the rigid lane cleaning system 20, for example. The levelers 50, which include hydraulic cylinders, may also be used to facilitate loading or unloading of the rigid lance cleaning system 20 from a vehicle. As an example, the levelers 50 may be configured to slide outwards from the frame 32 such that when the cylinders are extended (downwards in FIG. 1), there is a clearance that permits a vehicle to be positioned under the system 20 to load or unload the system. The frame 32 may also include various attachment features 51 for moving the rigid lance cleaning system 20, such as with a crane.

The rigid lance cleaning system 20 may further include a hose connector drive system 52 that fluidly connects each individual flexible hose 28 with a respective one of the rigid tubular lances 24 and facilitates moving the rigid tubular lances 24. A pitch adjuster 54 may also be arranged with the rigid tubular lances 24 and configured to change a spacing between centerlines of the rigid tubular lances 24. As discussed briefly above, the illustrated arrangement need not include all of the disclosed components. For instance, although the illustrated arrangement includes a full compliment of features, some components such as the hose reel 30, the drive system 38, the latches 48, the hose connector drive system 52, and the pitch adjuster 54 are considered to be optional. Each of these respective components will be described in further detail below.

Figure 3:
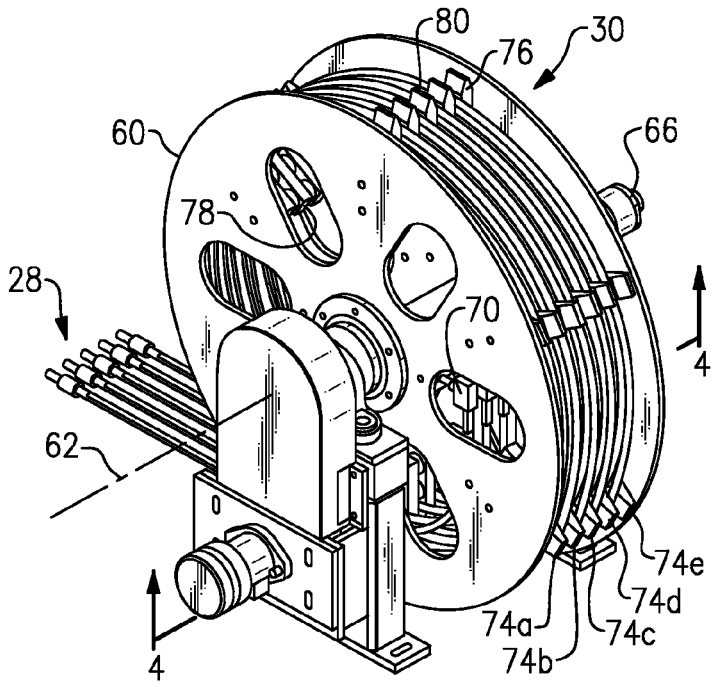
FIG. 3 illustrates an example hose reel for a rigid lance cleaning system.
Figure 4:
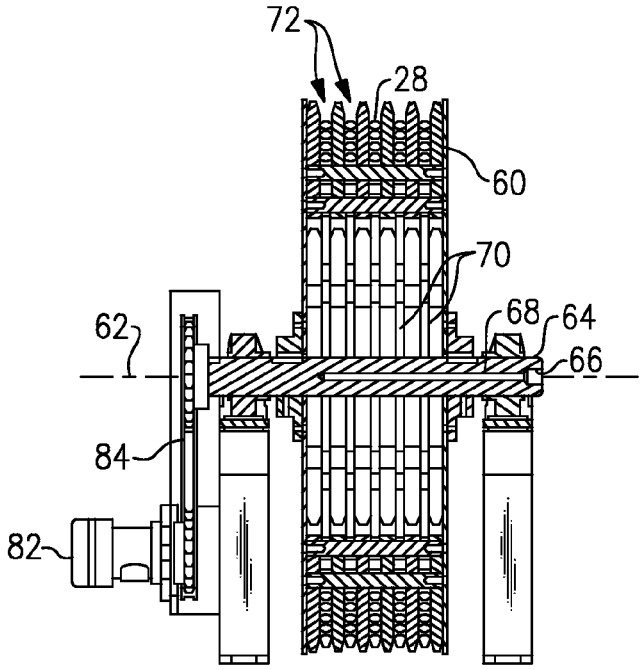
FIG. 4 illustrates a cross-sectional view of the hose reel of FIG. 3.

FIG. 3 illustrates a perspective view of the hose reel 30 and FIG. 4 illustrates a sectioned view of the hose reel 30. As with the rigid lance cleaning system 20, the illustrated hose reel 30 also need not include each of the reel components and features in the illustrated embodiment. However, in this example, the hose reel 30 includes a drum 60 for holding the flexible hoses 28. The drum 60 is rotatable about an axis 62 to selectively dispense or collect the flexible hoses 28. In this case, the drum 60 is mounted on an axle 64 that also serves to deliver the high pressure cleaning fluid to the flexible hoses 28. In this regard, the axle 64 includes a high pressure inlet 66 that is fluidly connected with a supply chamber 68. The supply chamber 68 is fluidly connected with a plurality of hose connectors 70 that may be attached to ends of respective ones of the flexible hoses 28 such that high pressure cleaning fluid supplied through the supply chamber 68 and hose connectors 70 is communicated to the flexible hoses 28.

The hose connectors 70 are generally axially aligned with respective slots 72 that extend circumferentially around the drum 60. Each of the slots 72 receives one of the flexible hoses 28. In this case, the slots 72 are formed between sets of guide members 74*a-e*. Each set 74*a-e* includes guide members 76, which may also be referred to as spacers, that are circumferentially spaced and axially aligned around the drum 60. That is, the guide members 76 of the set 74*a* are axially spaced from the guide members 76 of set 74*b* such that the slot 72 extends therebetween. The other slots 72 are likewise formed between the sets 74*c*, 74*d*, and 74*e*.

In the illustrated example, each guide member 76 includes a fixed base 78 and a free end 80. The free end 80 may be tapered to facilitate guiding the flexible hoses 28 into the slots 72. That is, if a flexible hose 28 is slightly axially offset from the corresponding slot 72, the taper of the guide members 76 guides the flexible hose 28 into the channel such that the flexible hose 28 remains axially aligned. In this regard, the hose reel 30 facilitates maintaining constant axial positioning of the flexible hoses 28, which may facilitate avoiding contact between the flexible hoses 28 and other components that can wear the flexible hoses 28 and reduce the need for other guidance structures or manual manipulation.

The hose reel 30 also may include a hydraulic actuator 82 that is coupled to the axle 64 with a chain 84 to selectively drive or rotate the hose reel 30 to collect the flexible hoses 28 on the drum 60. As may be appreciated, an "actuator" as referenced in this description may refer to a motor or other type of drive device. The operation of the hydraulic actuator 82 will be further described with reference to the drive system 38.

Figure 5:
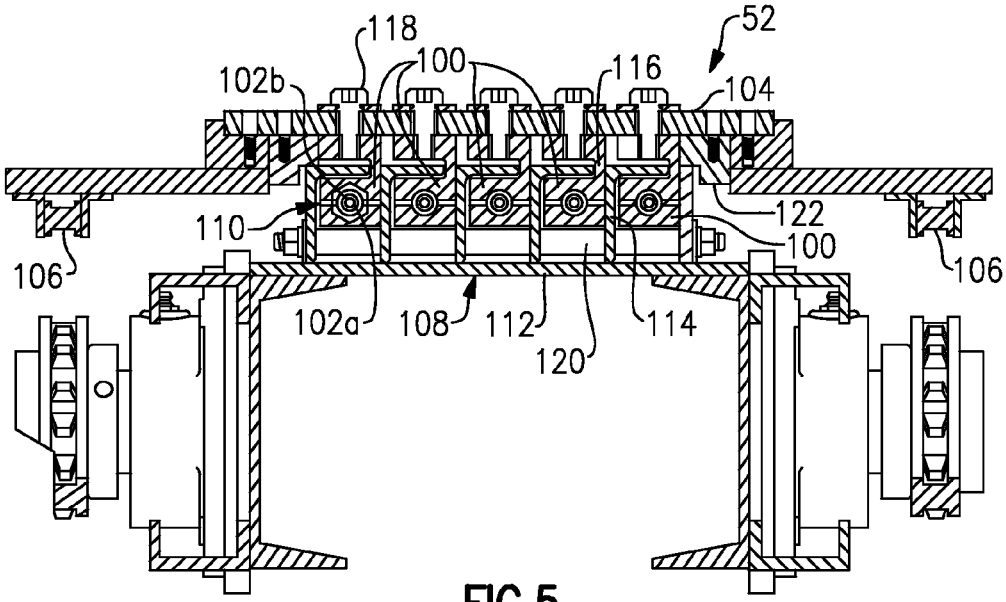
FIG. 5 illustrates an example hose connector drive system in a rigid lance cleaning system.
Figure 6:
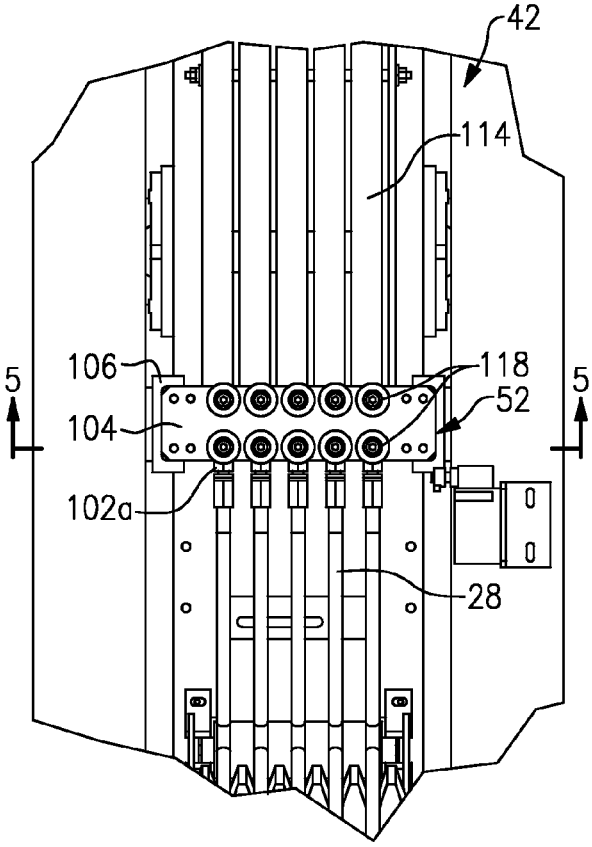
FIG. 6 illustrates a top view of the hose connector drive system of FIG. 5.

FIG. 5 illustrates a cross-sectional view of the hose connector drive system 52, and FIG. 6 illustrates a top-down view of the hose connector drive system 52. In this case, the hose connector drive system 52 includes a plurality of connection blocks 100 for attaching each individual flexible hose 28 to a respective one of the rigid tubular lances 24. In this case, each of the connection blocks 100 includes a hose port 102*a* and a lance port 102*b* (back side). As an example, the hose port 102*a* may be threaded for connection with a threaded end of a flexible hose 28. Likewise, the lance port 102*b* may be threaded for connection with a threaded end of one of the rigid tubular lances 24. Of course, other types of connections may be provided instead of threaded connections.

Each of the connection blocks 100 is secured to a common drive plate 104 that is configured to be driven by the drive system 38. For example, the drive system 38 drives a chain (not shown) that is engaged with a chain bracket 106 secured to the common drive plate 104 to translate the drive plate 104 along the direction 26 and thereby move the rigid tubular lances 24. As may be appreciated, other types of drive systems or dedicated drives may be used to move the hose connector drive system 52.

In this case, the connection blocks 100 translate within a guide frame 108 that may be part of the lance bed 42, for example. The guide frame 108 includes a plurality of channels 110 that are each configured to guide a respective one of the connection blocks 100. That is, each of the guide channels 110 limits lateral movement of the connection block 100 relative to the translation direction 26.

The guide frame 108 includes a bottom plate 112 and a plurality of frame members 114 that are generally L-shaped to form two adjacent walls of the channels 110. Thus, the bottom plate 112 forms the bottom wall of the channels 110, the frame members 114 form the left side and top side walls of the guide channels 110, and the back sides of each of the frame members 114 form the right side of the adjacent channels 110.

A gap 116 extends between the tip of the frame member 114 and the adjacent frame member 114 such that a portion of each of the connection blocks 100 can extend through the gap 116 for connection to the common drive plate 104. In this case, each connection block 100 may be secured to the common drive plate 104 using a fastener 118 or the like. There may be a clearance between each fastener 118 and the respective hole in the common drive plate 104 that provides the connection blocks 100 some play to self center within the channels 110 during installation, and to allow for manufacturing tolerances.

As may be appreciated, the individual connection blocks 100 may be removed by removing the associated fasteners 118 and replaced with a like connection block 100 in the case that the original connection block 100 becomes damaged or worn out. Thus, the disclosed hose connector drive system 52 provides the benefit of replaceable parts without having to replace the entire assembly.

Optionally, rollers 120 may be provided between the bottom plate 112 and the bottoms of the connection blocks 100 to facilitate translation of the flexible hoses 28 and rigid tubular lances 24 along the translation direction 26. The rollers may be spaced apart or positioned relatively close together and additionally support the flexible hoses 28 and rigid tubular lances 24. Thus, the rollers 120, the frame members 114, and the bottom plate 112 support the rigid tubular lances 24 and limit lateral movement in the case that one or more of the rigid tubular lances 24 become jammed in the tube bundle and thereby prevent or limit damage to the rigid tubular lances 24.

Additionally, one or more wear pads 122 may be provided between the common drive plate 104 and the tops of one or more of the frame members 114. As illustrated, there is space between the connecting portions of the connection blocks 100 and the tops of the frame members 114 to allow free movement of the connection blocks 100. However, to limit contact between the connection blocks 100 and the frame members 114, the wear pads 122 provide a predetermined spacing such that the connection blocks 100 do not bottom-out on the tops of the frame members 114. The wear pads 122 may be removably secured to the common drive plate 104, the chain drive brackets 106, or other components within the hose connector drive system 52. Thus, after a period of use when the wear pads 122 become worn, the wear pads 122 may be removed and replaced.

Figure 7:
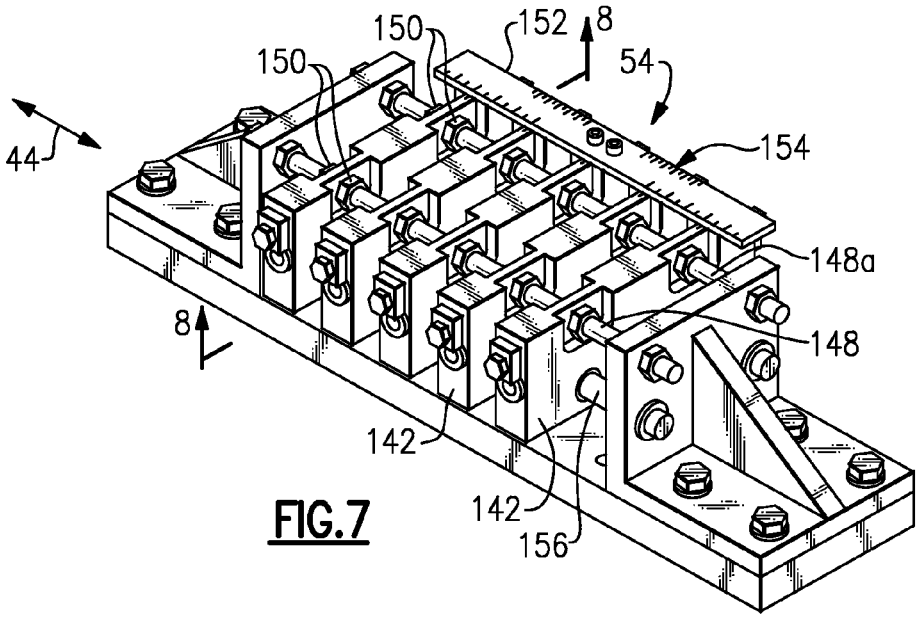
FIG. 7 illustrates an example pitch adjuster for a rigid lance cleaning system.
Figure 8:
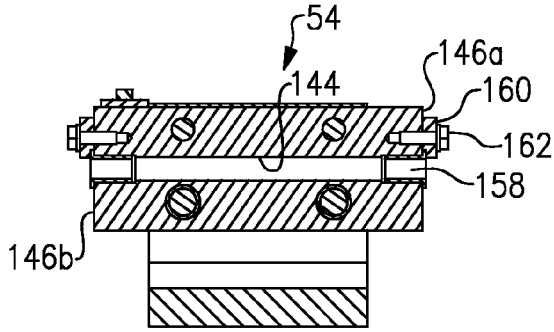
FIG. 8 illustrates a sectioned view of the pitch adjuster of FIG. 7.

FIG. 7 illustrates a perspective view of the pitch adjuster 54, and FIG. 8 illustrates a sectioned view of the pitch adjuster 54. In this example, the pitch adjuster 54 includes a plurality of pitch blocks 142. Each of the pitch blocks 142 includes an opening 144 that extends between a first end 146*a* and a second end 146*b*. The rigid tubular lances 24 extend through respective ones of the openings 144 such that the pitch blocks 142 generally determine the position of the centerlines of the rigid tubular lances 24. Thus, shifting the pitch blocks 142 along translation direction 44 serves to move the centerlines of the rigid tubular lances 24.

The pitch blocks 142 are spaced apart and mounted on a threaded rod 148. Depending upon the size and shape of the pitch blocks 142, more than one threaded rod 148*a* may be used. Each pitch block 142 includes a pair of associated adjustment members 150, with one adjustment member 150 on each side of the associated pitch block 142. The adjustment members 150 may be threaded such that rotation of each of the adjustment members 150 causes translation of the pitch block 142 along the threaded rod 148 and/or threaded rod 148*a*. Thus, the adjustment members 150 for each of the pitch blocks 142 may be adjusted such that there is a desirable spacing, or pitch, between the centerlines of the rigid tubular lances 24, which allows a user/operator to adjust the rigid tubular lances 24 for different heat exchanger designs. In this regard, the pitch adjuster 54 may include a pitch scale 152 that includes indicia 154 for determining the pitch of the rigid tubular lances 24. For instance, the indicia 154 may be laser etched onto the pitch adjuster 54. The scale 152 may be marked "1:1" for the inner pitch blocks 142 and "2:1" for the outer pitch blocks 142. The center block 142 may be fixed.

Optionally, the pitch adjuster 54 may also include one or more guide rods 156 on which the pitch blocks 142 are mounted. The guide rods 156 may be relatively smooth and spaced apart from the threaded rods 148 and/or 148*a* to facilitate lateral movement of the pitch blocks 142.

The pitch adjuster 54 may also include at least one wear bushing 158 mounted with respect to the opening 144. In this case, one wear bushing 158 may be included on each end of the opening 144 at the first side 146*a* and the second side 146*b*. Each of the wear bushings 158 may be held in place using a corresponding retainer 160. The retainer 160 is removably secured to the pitch block 142 with a fastener 162 or the like. Thus, if one of the wear bushings 158 becomes damaged or worn out, that wear bushing 158 can be removed and replaced simply by loosening or removing the associated retainer 160 and then re-tightening the retainer 160 once the new wear bushing is in place. As an example, the wear bushing 158 may be formed of a low friction material, such as a bronze material, that facilitates sliding movement of the rigid tubular lances 24 through the pitch blocks 142.

Figure 9:
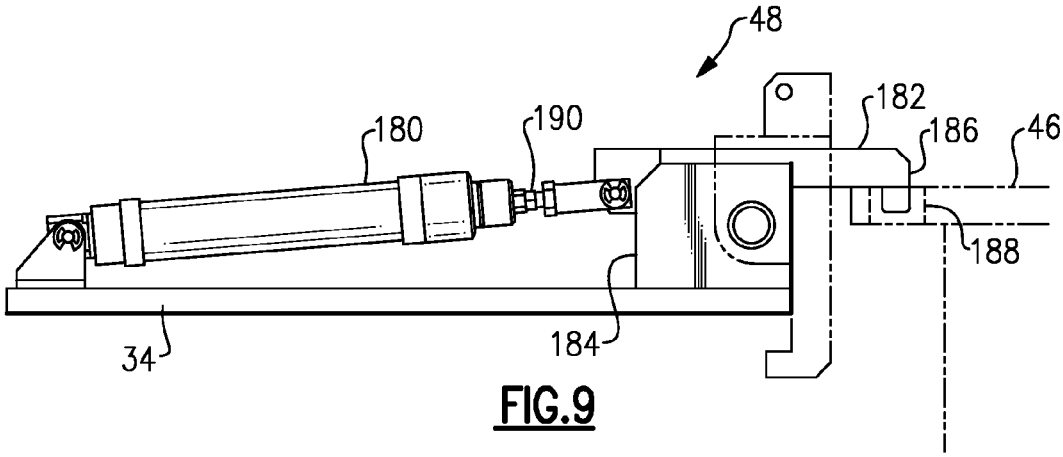
FIG. 9 illustrates an example latch for a platform of a rigid lance cleaning system.

FIG. 9 illustrates an example of the latch 48. In this example, the latch 48 is secured to the operator platform 34 and selectively engages a portion of the platform guide member 46 to secure the operator platform 34 in the operating position. As may be appreciated, the latch 48 may alternatively be secured to other portions of the frame 32, such as the platform guide members 46 and is therefore not limited to the illustrated arrangement.

The latch 48 includes a hydraulic actuator 180 that is movable between extended and retracted positions to move a latch member 182 between a locked position and an unlocked position (shown in phantom). In this regard, the latch 48 may be considered to be a powered latch that is machine-actuated rather than manually actuated. The latch member 182 is pivotably secured to a latch bracket 184 that is mounted on the operator platform 34. In this case, the latch member 182 has a hooked end 186 for engaging a slot 188 on the platform guide member 46. Alternatively, the latch member 182 could include the slot 188 and the platform guide member 46 could include the hooked end 186 or similar locking feature.

In the illustrated example, the hydraulic actuator 180 is a hydraulic cylinder that is coupled to an end of the latch member 182. Movement of a piston within the hydraulic cylinder selectively extends a link 190 to actuate the latch member 182. In this case, extension of the link 190 pivots the latch member 182 to the unlocked position and retraction of the link 190 moves the latch member 182 to the locked position.

The latch 48 is generally designed to avoid inadvertent movement of the latch member 182 from the locked position to the unlocked position. In this case, when the latch member 182 is in the locked position engaged with the slot 188, the latch member 182 cannot be pivoted to the unlocked position without first disengaging the hooked end 186 from the slot 188. That is, the entire operator platform 34 and latch 48 must first be raised relative to the platform guide member 46 to lift the hooked end 186 out of the slot 188. Only after the lifting will the latch member 182 be clear of the platform guide member 46 and thereby able to pivot to the unlocked position. Thus, without first intentionally lifting the operator platform 34, the latches 48 cannot be unlocked.

Figure 10:
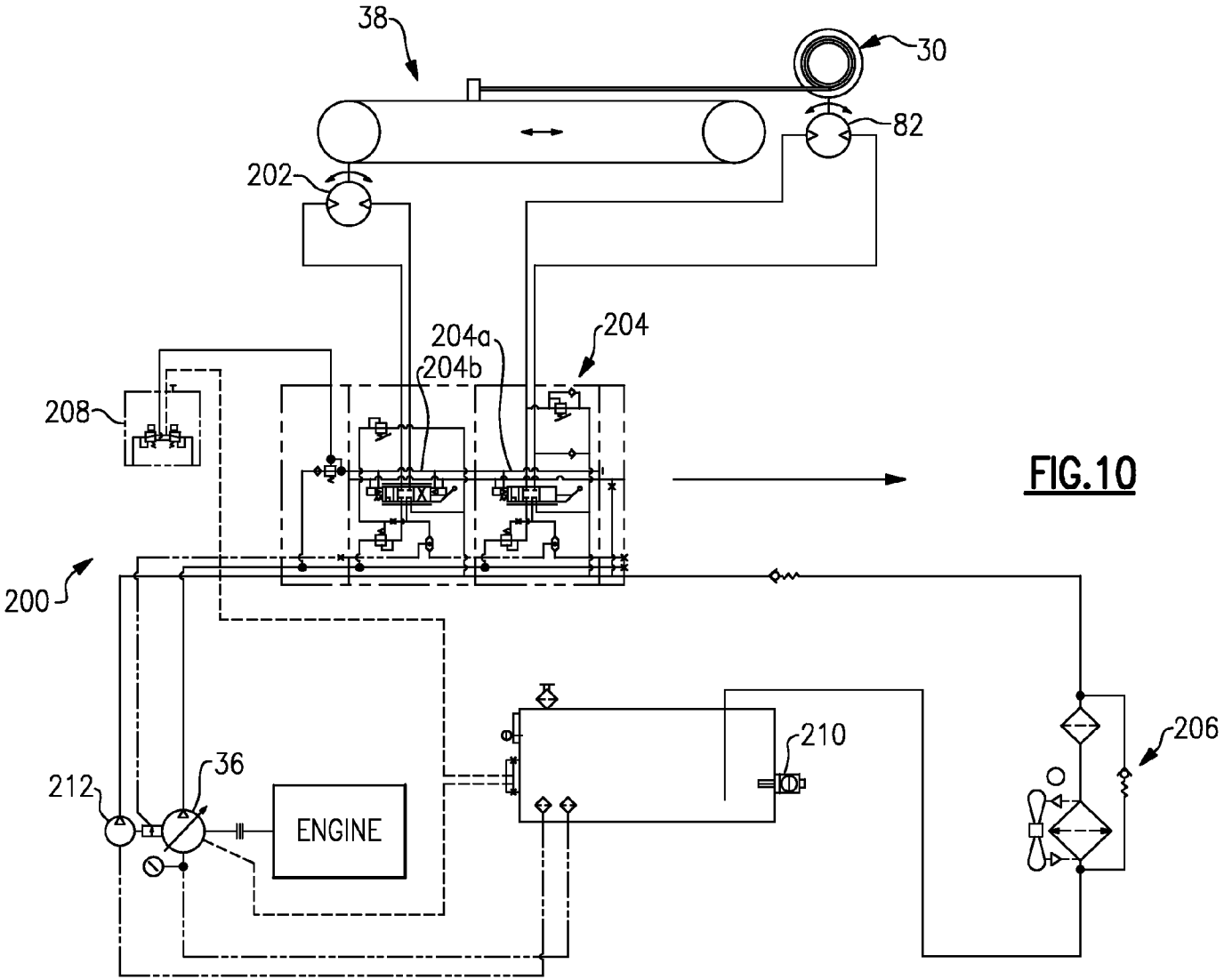
FIG. 10 illustrates an example drive system for a rigid lance cleaning system.

FIG. 10 illustrates a schematic representation of the drive system 38. As previously described, the drive system 38 includes a primary hydraulic pump 36 that may be used to drive all or most of the movement of the components within the rigid lance cleaning system 20. In this regard, the drive system 38 includes a hydraulic circuit 200 for controlling movement. The hydraulic actuator 82 of the hose reel 30 and another hydraulic actuator 202 that is used to move the hose connector drive system 52 may be interconnected hydraulically within the circuit 200.

In one example, the hydraulic actuator 202 for moving the hose connector drive system 52 and rigid tubular lances 24 may be more powerful and have a higher torque rating than the hydraulic actuator 82 of the hose reel 30. As will be described, the higher torque rating of the hydraulic actuator 202 may be used to establish and maintain a tension on the flexible hoses 28 during dispensing, collecting, or both to limit slack in the flexible hoses 28.

In general, the drive system 38 may include, in addition to the components already described, a valve system 204, a filter 206, a controller 208 (which may be mounted within the operator cab 22), a reservoir 210, an auxiliary pump 212, and optionally other components for controlling the operation of the drive system 38. In this case, the primary hydraulic pump 36 is fluidly connected with each of the hydraulic actuators 82 and 202 through the valve system 204. The return fluid flows through the filter 206 into the reservoir 210 before again being drawn into the primary hydraulic pump 36 for another cycle. The auxiliary pump 212 may be provided in conjunction with the primary hydraulic pump 36 for supplying additional hydraulic fluid to the hydraulic actuator 82 of the hose reel 30.

The valve system 204 may include a plurality of valves 204*a* and 204*b* for controlling communication of hydraulic fluid to or from the respective hydraulic actuators 82 and 202. In this case, the valve 204 serves as a pressure relief valve that is used during the operation of the rigid lance cleaning system 20 to facilitate maintaining a tension on the flexible hoses 28. For instance, when the flexible hoses 28 are dispensed from the hose reel 30 in connection with extension of the rigid tubular lances 24, the hydraulic actuator 82 of the hose reel 30 is deactivated and the hydraulic actuator 202 is driven using the primary hydraulic pump 36 to move the hose connector drive system 52 and rigid tubular lances 24. In this regard, the hydraulic actuator 202 pulls the flexible hoses 28 off of the hose reel 30 and thereby mechanically turns the hose reel and hydraulic actuator 82. In essence, the mechanical driving of the hydraulic actuator 82 converts the actuator 82 into a pump that discharges hydraulic fluid and draws in hydraulic fluid from the primary hydraulic pump 36. Under such an operating condition, the valve 204 remains closed until a desired pressure of hydraulic fluid is built up from the pumping action of the hydraulic actuator 82. At the threshold level, such as around 500 psi, the valve 204 opens to allow discharge of hydraulic fluid. The pressure built up within the hydraulic actuator 82 provides a resistance to rotation of the hose reel 30 that causes tension on the flexible hoses 28 as the hydraulic actuator 202 pulls the flexible hoses 28 off of the hose reel 30. Without the resistance provided by the pumping action of the hydraulic actuator 82, the hose reel 30 would freely turn and produce slack in the hoses from the increase in speed of the hose reel 30 as progressively more hose is dispensed.

To avoid potential cavitation in the hydraulic actuator 82 from the pumping action, the auxiliary pump 212 may be used to provide additional hydraulic fluid to the hydraulic actuator 82.

After a cleaning operation is conducted and the rigid tubular lances 24 are to be retracted, the hydraulic actuator 202 and the hydraulic actuator 82 are activated to collect the flexible hoses 28 on the hose reel 30. In this case, the hydraulic actuator 82 is designed to be faster than the hydraulic actuator 202 but is not as powerful as the hydraulic actuator 202 (i.e. lower torque rating). Thus, the hydraulic actuator 82 attempts to collect the flexible hoses 28 at a faster rate than the hydraulic actuator 202 retracts the rigid tubular lances 24. However, since the hydraulic actuator 82 is not as powerful as the hydraulic actuator 202, a tension is provided on the flexible hoses 28, which prevents slack.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from the essence of this disclosure. The scope of legal protection given to this disclosure can only be determined by studying the following claims.

What is claimed is:

1. A rigid lance cleaning system comprising:

a plurality of rigid tubular lances moveable between retracted and extended positions for delivering a cleaning fluid, each of the plurality of rigid tubular lances including a free end and a spray device coupled to the free end;

a plurality of flexible hoses connected, respectively, to the plurality of rigid tubular lances for delivering the cleaning fluid to the plurality of rigid tubular lances;

a hose reel configured to dispense the plurality of flexible hoses when the plurality of rigid tubular lances extend and collect the plurality of flexible hoses when the rigid tubular lances retract;

a frame that moveably supports the plurality of rigid tubular lances;

a drive system configured to selectively extend and retract the plurality of rigid tubular lances; and a hose connector drive system fluidly connecting each individual one of the plurality of flexible hoses to a corresponding one of the plurality of rigid tubular lances.

2. The rigid lance cleaning system as recited in claim 1, wherein the hose reel includes circumferential slots that each receives one of the plurality of flexible hoses.

3. The rigid lance cleaning system as recited in claim 2, wherein the hose reel includes multiple sets of guide members, with the guide members of each set being circumferentially spaced around the hose reel and axially spaced from the guide members of a neighboring set such that the circumferential slots extend between the sets of guide members.

4. The rigid lance cleaning system as recited in claim 3, wherein each of the guide members includes a fixed base and a free end, and the free end is tapered.

5. The rigid lance cleaning system as recited in claim 1, wherein the hose reel includes a high pressure inlet fluidly connected with a supply chamber, and hose connectors that extend from the supply chamber and that are connected to respective ones of the plurality of flexible hoses.

6. The rigid lance cleaning system as recited in claim 1, wherein the hose reel includes a hydraulic drive that is within a hydraulic circuit of the drive system.

7. The rigid lance cleaning system as recited in claim 1, wherein the hose connector drive system includes a plurality of connection blocks that are individually removable from the hose connector drive system, each connection block including a hose port for attaching to one of the plurality of flexible hoses and a lance port for attaching to one of the plurality of rigid tubular lances.

8. The rigid lance cleaning system as recited in claim 7, wherein the plurality of connection blocks are secured to a common drive plate that is configured to be driven by the drive system to move the plurality of rigid tubular lances.

9. The rigid lance cleaning system as recited in claim 8, further comprising a guide frame that includes a plurality of channels each having a plurality of channel walls that limit lateral movement of the plurality of rigid tubular lances relative to movement to retract or extend the plurality of rigid tubular lances, and the plurality of connection blocks are received within corresponding ones of the channels.

10. The rigid lance cleaning system as recited in claim 8, further comprising a wear pad between at least one of the plurality of connection blocks and the common drive plate.

11. The rigid lance cleaning system as recited in claim 1, further comprising a pitch adjuster arranged with the plurality of rigid tubular lances and configured to change a spacing between centerlines of the plurality of rigid tubular lances.

12. The rigid lance cleaning system as recited in claim 11, wherein the pitch adjuster includes a pitch scale having indicia for determining the spacing of the plurality of rigid tubular lances.

13. The rigid lance cleaning system as recited in claim 11, wherein the pitch adjuster includes a plurality of pitch blocks, each pitch block includes an opening through which one of the plurality of rigid tubular lances extends, and the pitch blocks are spaced apart and mounted on a threaded rod that includes adjustment members on each side of each of the pitch blocks for selectively moving and securing the blocks at desired positions.

14. The rigid lance cleaning system as recited in claim 13, wherein the plurality of pitch blocks are mounted on a guide rod that is spaced apart from the threaded rod.

15. The rigid lance cleaning system as recited in claim 13, wherein each of the plurality of pitch blocks includes at least one wear bushing mounted with respect to the opening to guide the respective one of the plurality of rigid tubular lances into the opening.

16. The rigid lance cleaning system as recited in claim 15, wherein each of the plurality of pitch blocks includes a removable retainer securing the respective bushing to the pitch block.

17. The rigid lance cleaning system as recited in claim 15, wherein the at least one wear bushing is formed from a bronze material.

18. The rigid lance cleaning system as recited in claim 1, wherein the frame includes an operator platform that is movable relative to the plurality of rigid tubular lances, and at least one latch that is configured to selectively secure the operator platform in an operating position.

19. The rigid lance cleaning system as recited in claim 18, wherein the at least one latch is a powered latch.

20. The rigid lance cleaning system as recited in claim 18, wherein the at least one latch includes a hydraulic actuator that is movable between extended and retracted positions to move a latch member between respective unlocked and locked positions.

21. The rigid lance cleaning system as recited in claim 20, wherein the hydraulic actuator is coupled to the latch member and the latch member is pivotably secured to a latch bracket such that movement of the hydraulic actuator pivots the latch member relative to the latch bracket.

22. A rigid lance cleaning system comprising:

a plurality of rigid tubular lances moveable between retracted and extended positions for delivering a cleaning fluid;

a plurality of flexible hoses connected, respectively, to the plurality of rigid tubular lances for delivering the cleaning fluid to the rigid tubular lances;

a hose reel configured to dispense the plurality of flexible hoses when the rigid tubular lances extend and collect the plurality of flexible hoses when the plurality of rigid tubular lances retract;

a frame that moveably supports the plurality of rigid tubular lances, wherein the frame includes an operator platform that is movable relative to the plurality of rigid tubular lances, and at least one latch that is configured to selectively secure the operator platform in an operating position, wherein the at least one latch includes a hydraulic actuator that is movable between extended and retracted positions to move a latch member between respective unlocked and locked positions, wherein the hydraulic actuator is coupled to the latch member and the latch member is pivotably secured to a latch bracket such that movement of the hydraulic actuator pivots the latch member relative to the latch bracket, wherein the latch member engages a platform guide member on the frame when in the locked position, at least one of the latch member or the platform guide member includes a hook and the other of the latch member and the platform guide member includes a slot for receiving the hook when in the locked position, and to remove the latch member from the locked position, the latch member lifts off of the platform guide member and then pivots to the unlocked position; and a drive system configured to selectively extend and retract the plurality of rigid tubular lances.

23. The rigid lance cleaning system as recited in claim 1, wherein the drive system includes first and second hydraulic actuators configured to respectively move the plurality of rigid tubular lances and the hose reel, and the first and second hydraulic actuators are hydraulically interconnected within a hydraulic circuit of the drive system.

24. The rigid lance cleaning system as recited in claim 23, wherein the first hydraulic actuator includes a first torque rating and the second hydraulic actuator includes a second torque rating that is lower than the first torque rating.

25. The rigid lance cleaning system as recited in claim 23, wherein the first hydraulic actuator is arranged to pull the plurality of flexible hoses from the hose reel and thereby mechanically turn the hose reel when dispensing the plurality of flexible hoses, thereby mechanically turning the second hydraulic actuator and pumping hydraulic fluid through the second hydraulic actuator.

26. The rigid lance cleaning system as recited in claim 25, wherein the drive system includes a pressure relief valve fluidly connected with the second hydraulic actuator and that is configured to open at a threshold pressure when the hose reel dispenses the plurality of flexible hoses to permit pumping of the hydraulic fluid through the second hydraulic actuator.

27. A rigid lance cleaning system comprising:

a plurality of rigid tubular lances moveable between retracted and extended positions for delivering a cleaning fluid;

a pitch adjuster arranged with the plurality of rigid tubular lances and configured to change a spacing between centerlines of the plurality of rigid tubular lances;

a plurality of flexible hoses connected, respectively, to the plurality of rigid tubular lances for delivering the cleaning fluid to the plurality of rigid tubular lances;

a hose connector drive system fluidly connecting each individual one of the plurality of flexible hoses to a corresponding one of the plurality of rigid tubular lances;

a hose reel configured to dispense the plurality of flexible hoses when the plurality of rigid tubular lances extend and collect the plurality of flexible hoses when the plurality of rigid tubular lances retract, the hose reel including circumferential slots that each receive one of the plurality of flexible hoses;

a frame that moveably supports the plurality of rigid tubular lances and an operator platform, the frame including at least one latch configured to selectively secure the operator platform at a desired position; and a drive system configured to selectively extend and retract the plurality of rigid tubular lances, the drive system including first and second hydraulic actuators configured to respectively move the plurality of rigid tubular lances and the hose reel, and the first and second hydraulic actuators are hydraulically interconnected.

28. The rigid lance cleaning system as recited in claim 1, wherein the frame includes an operator platform that has controls operable to move the plurality of rigid tubular lances, the operator platform being movable relative to the plurality of rigid tubular lances, and at least one latch that is configured to selectively secure the operator platform in an operating position.

29. The rigid lance cleaning system as recited in claim 28, wherein the operator platform is vertically movable relative to the plurality of rigid tubular lances.

30. The rigid lance cleaning system as recited in claim 1, wherein each of the plurality of rigid tubular lances is connected at an opposing end from the respective free end to one of the plurality of flexible hoses.

31. The rigid lance cleaning system as recited in claim 27, wherein the operator platform has controls operable to move the plurality of rigid tubular lances, the operator platform being movable relative to the plurality of rigid tubular lances.

32. The rigid lance cleaning system as recited in claim 31, wherein the operator platform is vertically movable relative to the plurality of rigid tubular lances.

* * * * *